US005363514A

United States Patent [19]

Lee

[11] Patent Number: 5,363,514

[45] Date of Patent: Nov. 15, 1994

[54] PORTABLE BEDPAN

[76] Inventor: Seong-Kyu Lee, 1/5, Whachun-dong 23-3, Jinhae-si, Kyeongsangnam-do, Rep. of Korea

[21] Appl. No.: 99,426

[22] Filed: Jul. 30, 1993

[30] Foreign Application Priority Data

Jun. 7, 1993 [KR] Rep. of Korea ..... 10233

[51] Int. Cl.[5] ..... A61G 9/00

[52] U.S. Cl. ..... 4/455; 4/450; 4/454; 4/457

[58] Field of Search ..... 4/443, 446, 447, 450, 4/451, 452, 453, 454, 455, 456, 457, 458, 114.1, 479, 480, 144.1, 144.3, 310, 311

[56] References Cited

U.S. PATENT DOCUMENTS

| | | | |
|---|---|---|---|
| 3,757,355 | 9/1973 | Allen et al. | 4/455 |
| 4,202,058 | 5/1980 | Anderson . | |
| 4,276,663 | 7/1981 | Gensurowsky | 4/443 |
| 4,368,548 | 1/1983 | Glass . | |
| 4,677,700 | 7/1987 | Su | 4/455 |
| 4,791,686 | 12/1988 | Taniguchi et al. | 4/144.3 |
| 4,920,587 | 5/1990 | Kerr . | |
| 4,962,551 | 10/1990 | Bly . | |
| 5,269,030 | 12/1993 | Pahno et al. | 4/480 |

FOREIGN PATENT DOCUMENTS

| | | | |
|---|---|---|---|
| 439806 | 9/1948 | Italy | 4/446 |
| 238835 | of 1980 | Japan . | |
| 62-2535 | 1/1987 | Japan . | |
| 4-39758 | 9/1992 | Japan . | |
| 40901 | 9/1992 | Japan . | |
| 4-45597 | 10/1992 | Japan . | |

*Primary Examiner*—Henry J. Recla
*Assistant Examiner*—Charles R. Eloshway
*Attorney, Agent, or Firm*—Fisher & Associates

[57] ABSTRACT

A portable bedpan operated by pump comprising a body including a water box, a remnant box, two filth boxes, and a vacuum pump, a pan engagable with the body, a pushing cylinder located in the body for pushing the bedpan and the front end of cylinder being detachably connected with the bedpan, a plurality of hoses contractibly connected between the first filth box and the bedpan, the first filth box sucking filth of the bedpan, the second filth box being interconnected with the first filth box so as to receive overflowing filth from the first filth box, a remnant box for accumulating remnant filth of the pan bottom, and plurality of valves installed at each connecting hose for regulating the fluid flow in connection with the pumping operation.

9 Claims, 4 Drawing Sheets

PORTABLE BEDPAN

BACKGROUND OF THE INVENTION

This invention relates to a portable bedpan for a patient or an infant, especially a portable bedpan usable in a room or a car in case of unavoidable circumstances.

The prior bedpan for patients has various forms, which have bulky constructions and are inconvenient to use. Even if there is a mechanically composed apparatus, each part is separately divided in constituting the whole apparatus, and occupies much space.

SUMMARY OF THE INVENTION

The object of this invention is to provide a bedpan which is convenient to use, and to provide a very compact bedpan which is conveniently portable.

These objects and other features will be made apparent from the following description, given by way of purely explanatory and by no means limitative example, in conjunction with the drawings herein.

DESCRIPTION OF THE PREFERRED EMBODIMENT

Figure 1:
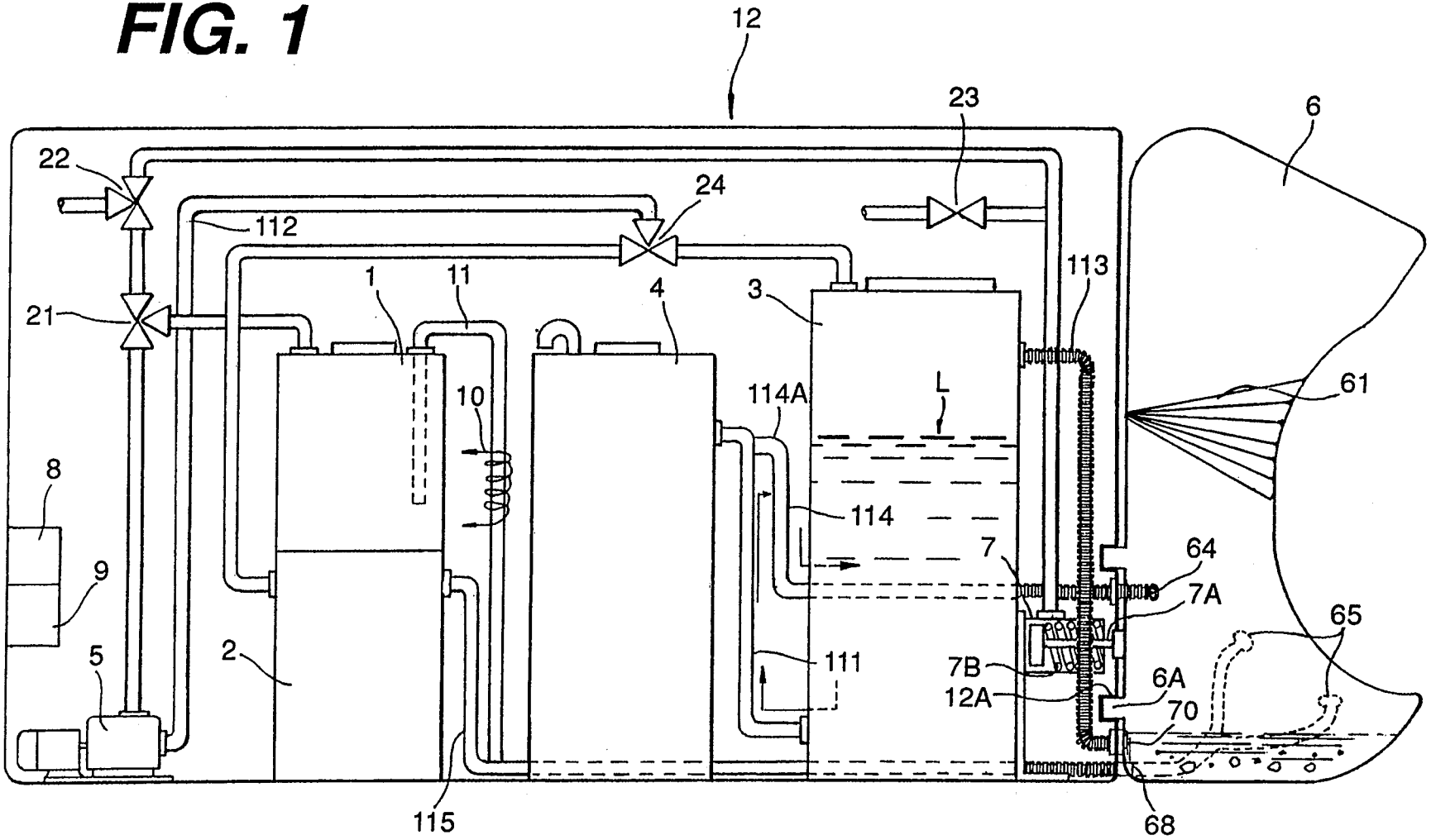
FIG. 1 is a side view elevation showing the inner construction of a bedpan in accordance with the present invention.
Figure 2:
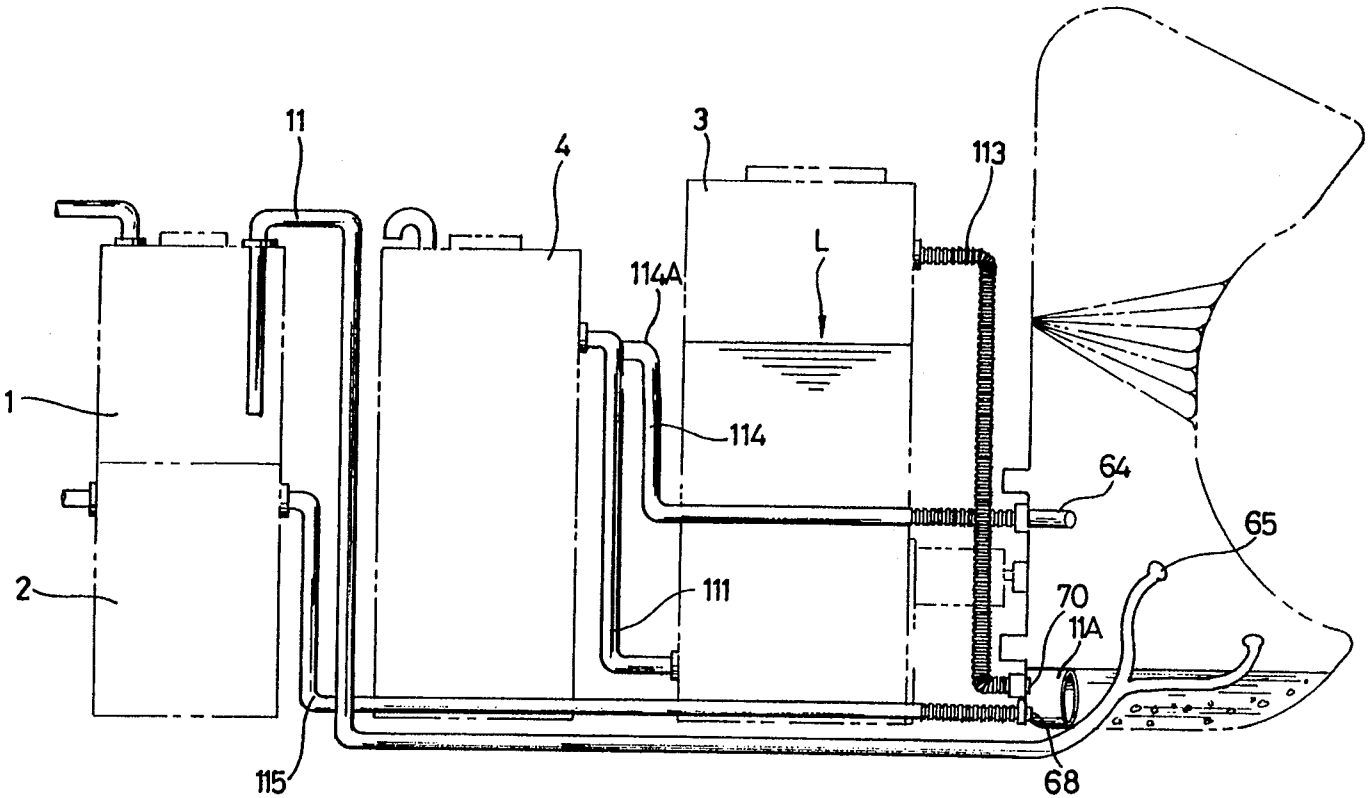
FIG. 2 is a schematic illustration of hose connections.

Referring to FIG. 1, the portable bedpan of the present invention is generally divided into two parts, a pan 6 and a body 12. The body 12 has a water box 1, a remnant box 2, a first filth box 3, a second filth box 4, and a vacuum pump 5. Between said boxes and the vacuum pump, a plurality of hoses are interconnected. At the front of the first filth box 3, the pan 6 is installed. The pan 6 has an accordion part 61 for foldability. Between the pan 6 and the first filth box 3, a pushing cylinder 7 is installed, the pushing cylinder 7 having a piston 7A and a spring 7B, and one end of the pushing cylinder being fixed to the side wall of the first filth box 3 with a bracket.

The first filth box 3 is filled with water to a predetermined water level L, but the second filth box 4 is not filled with water. Between the first filth box 3 and the second filth box 4, hoses 111, 114, are connected. Thus, when water is filled into the first filth box 3, the water will never be higher than the predetermined water level L (which is the same level as the stepped hose 114A) because the end of the hose 114 drains through a hole 64.

On one side of the rear part of the portable bedpan, a controller 8 and a power supply 9 are installed. Between the water box 1 and the pan 6 a hose 11 is connected, and around the hose 11 close to the water box 1 a heater means 10 is installed so that it is possible to provide warmed water or warmed air to the pan 6.

Figure 3:
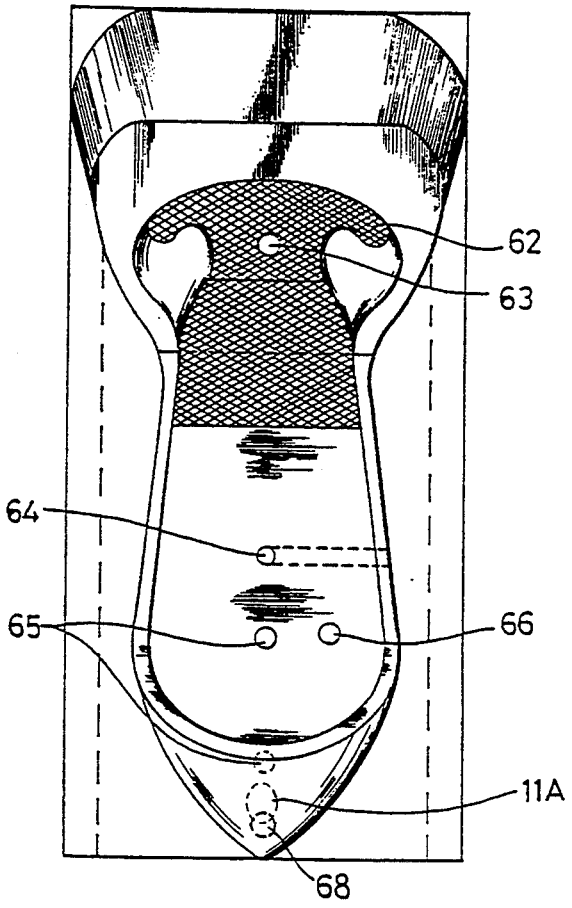
FIG. 3 is a frontal view of the present invention.

FIG. 3 is a right side view of FIG. 1, which shows holes in pan 6. On the inner upper surface a rubber plate 62 and a first hole 63 are formed to prevent splashing of urine when one urinates. Under the first hole 63, a second hole 64 through which water of the first filth box 4 flows out via hoses 111, 114, a plurality of holes 65 through which water of water box 1 is sprayed after excretion, a fourth hole 66 being a ventilation hole for preventing the corresponding part of the body from being compressed, a fifth hole 70 through which urine or excretion is sucked and then introduced into the first filth box 3, and a sixth hole 68 through which the remnant filth is sucked into the remnant box 2, are respectively formed.

As shown in FIG. 1, the plurality of holes 65 are connected with the water box 1 via hose 11 such that water of the water box 1 can be introduced through said holes 65 after excretion. In such case, warn water is sprayed on the anus because a heater means 10 is installed around the hose 11. After exhaustion of the warm water, warm air is blown.

Figure 4:
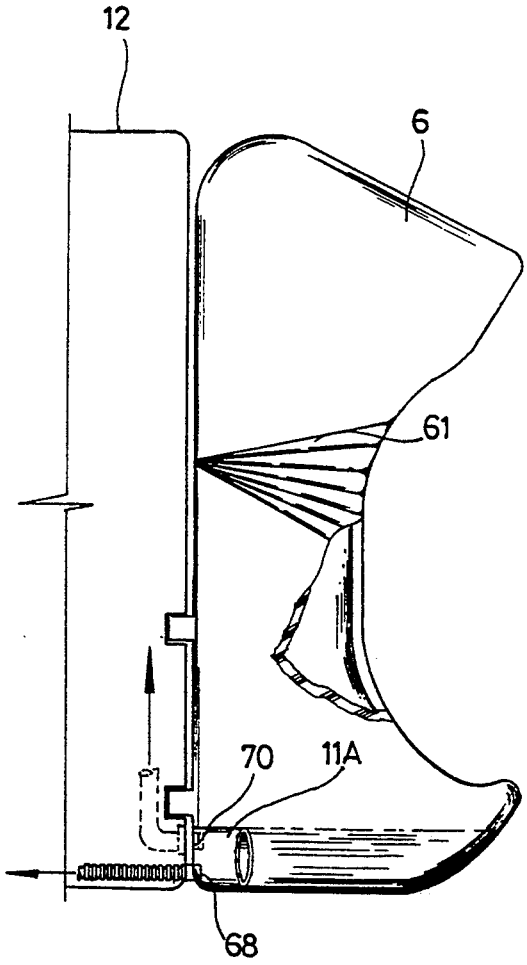
FIG. 4 is a partially sectioned side view of the bedpan.

As shown in FIG. 4, the filth hole 70 is a hose hole through which urine or excretion is sucked into the first filth box 3 via hose 113, and sixth hole 68 is a hose hole through which remnant filth may be sucked via hose 115.

FIG. 1 shows the connection between the body 12 and the pan 6 being constituted with a pair of recessed portions 12A of body 12 and a pair of protrusions 6A of pan 6. All of the hoses between the body 12 and the pan 6 except the connecting hose 114 are connected at the lower part of FIG. 1.

Forward movement of the bedpan 6 is accomplished by pushing cylinder 7 having piston 7A and inner spring 7B. The front end of the piston 7A has a connecting means or interlocking means, for example a detachable ring, a link, a loop or a ratch, etc. In connection with the pushing cylinder operation, the hoses are formed with contractible accordion members. Accordingly, if necessary, the pan 6 can also be detached from the body 12 and located at a desired place within a predetermined distance.

Hereinafter, the operation of the bedpan in accordance with aforesaid construction will be described in detail with an explanation of valve operation.

Prior to operation, water is filled in the water box 1 and the first filth box 3, so the vacuum pump 5 may be operated. For operation of the pushing cylinder, as can be seen in FIG. 1, when a cylinder switch (not shown) constituted on the controller 8 is turned "on" a first valve 21 closes off the passage to the water box 1, and a second valve 22 closes off the passage of air ventilation so that air pressure is applied to the piston 7A moving the pushing cylinder 7 forward, the protrusion 6A of pan 6 separates from the recessed portion 12A of body 12, and the front surface of the pan 6 contacts with a part of the person's body.

In contrast, if the cylinder switch (not shown) of the controller 8 is turned "off", the first valve 21 closes off the passage to the water box 1, the passage to the pushing cylinder 7 is closed off by the second valve 22, and the air ventilation passage of a third valve 23 and the second valve 22 is opened so that the compressed air in the pushing cylinder may be release. Accordingly, by the inner spring 7B of the pushing cylinder 7 the piston 7A is retracted into its original position and the pan 6 returns to a position joined with the body 12 because the 5protrusion of pan 6 is inserted into the recessed portion 12A of body 12. Meanwhile, since the inner hoses of the body 12 interconnecting with the pan 6 are made of contractible members, even if the pan 6 is separated from the body 12 by a predetermined distance, there are no problems such as disconnections or cutting of hoses.

Referring to bedpan flushing operation via said vacuum pump operation in relation to a fourth valve 24, one end of hose 112 is connected with vacuum pump 5 and the other end is connected with the three way fourth valve 24. For flushing operation, the first valve 21 closes off the passage of air to the water box 1, the second valve 22 closes off the passage of air to the pushing cylinder 7 and the fourth valve 24 closes off the passage to the remnant box 2. Then, by operation of the vacuum pump 5, water from the first filth box 3 flows out via hoses 111 and 114 through the second hole 64 of pan 6. Thereby, urine or excrement is mixed with water, gathered at the hole 70 (shown in FIG. 3), and sucked back into the first filth box 3 through the filth hole 70 and the suction hose 113, since when the compressed air by the vacuum pump 5 is applied to water in the first filth box 3 and water flows into the pan 6, the air space within the first filth box 3 becomes vacuumized and water and filth is instantly sucked through the filth hole 70 and into the vacuous upper space of the first filth box 3.

In this case, water or filth which overflows the predetermined water level L of the first filth box 3 is introduced into the second filth box 4 through the hose 111 because if the water level L of the first filth box 3 is higher than the highest level 114A of connecting hose 114, fluid pressure is applied in a downward direction. Overflowing water and filth does not flow through the second hole 64 because, at the end of second hole 64 there is a pressure sensitive floater (not shown) which is opened only in case a predetermined pressure is applied. Accordingly, it is opened only when the pressure of the vacuum pump 5 is applied, however, when suction occurs through the hose 113, overflowing filth or water does not flow out from the second hole 64 because the pressure of overflowing filth or water is lower than the pressure required to open the floater (not shown).

Hereinafter, the human body-washing operation after excretion will be explained. The second valve 22 and the fourth valve 24 close off all passage of air from vacuum pump. Consequently, the pressurized air of pump 5 goes toward the water box 1. Thus, water of water box 1 is forced out and sprayed on the user's body through the holes 65. In this case, warm water is sprayed because a heater means is wound around the hose 11. After complete consumption of water of water box 1, compressed air is blown into the water box 1. The air is heated by said heater means 10 in the aforementioned way, and the heated air is blown out through the holes 65 so that the body is dried. Meanwhile, the washing water remains in the bottom of pan 6.

Hereinafter, the suction operation of the remnant water remaining in the bottom of pan 6 will be explained. By the controller operation, the first valve 21 closes off all passage of air, the second valve 22 closes off all passage of air and the fourth valve 24 closes off the passage which proceeds toward the first filth box 3, however, it opens the passage which proceeds toward the remnant box 2. Therefore, when the suction operation of air by the vacuum pump 5 is made, remnant water remaining in the bottom of the hose 11A is completely sucked into the remnant box 2 through the sixth hole 68 and the hose 115.

In accordance with the present invention, it is possible to make a very compact and easily portable bedpan apparatus. As a result, it is possible to use said bedpan apparatus in a hospital bed, in a car, or in a room.

While the invention has been illustrated and described with one embodiment, it is recognized that variations and changes can be made without departing from the scope and spirit of the invention. For example, even though said portable bedpan is operated by controller 8, it is possible to operate it with a remote controller, especially in case that the user is a patient.

Also, since each hose connecting the first filth box 3, the second filth box 4, the remnant box 2, and the water box 1 may be detachably connected, each box comprising filth or contents can be removed from the body 12 of the portable bedpan. Therefore, if spare filth boxes are prepared, it is very convenient to use because each box can be exchanged.

What is claimed:

1. A portable bedpan operated by a pump and a controller comprising:

a pan;

a body accommodating a first filth box, a second filth box, a remnant box, and a water box, said first filth box being connected with the pump via a conduit and with the pan via a hose, said second filth box being connected with the first filth box via a hose, said hose connecting said first and second filth boxes being connected at its upper portion with a hose connecting with the pan, said remnant box being connected via a hose with a lower portion of said pan and being connected with the pump via a conduit, and said water box being connected via a conduit with the pump and being connected with said lower portion of said pan via a hose;

said pan having a hole connected with said hose connecting the first and second filth boxes, a plurality of holes connected with the hose connecting the water box and the pan, and a suction hole connected with the hose connecting the pan and the first filth box and the hose connecting the remnant box and the pan;

a pushing cylinder connected via a conduit to said pump for pushing said pan by pump operation; and four valves, one each installed in said connecting conduits for regulating air flow in connection with said pump operation.

2. A portable bed pan as set forth in claim 1 wherein said pan is detachable from the body by a detaching means.

3. A portable bedpan as set forth in claim 2 wherein said detaching means comprises said pan having a plurality of protrusions and said body has a plurality of recessed portions corresponding to said protrusions.

4. A portable bedpan as set forth in claim 1 wherein said pan has an accordion member in its middle portion.

5. A portable bedpan as set forth in claim 1 wherein said hoses connecting between the pan and the boxes comprise contractible members.

6. A portable bedpan as set forth in claim 1 wherein one end of said cylinder is fixed on a side wall of said first filth box and an other end is detachably connected with the pan.

7. A portable bedpan as set forth in claim 1 wherein said pushing cylinder has a spring which is inserted around a piston.

8. A portable bedpan as set forth in claim 1 wherein a heater means is adapted to be installed around said hose connecting between the water box and the pan.

9. A portable bedpan as set forth in claim 1 wherein said boxes are detaching from the body by a detachable means.

* * * * *